US007075096B2

(12) United States Patent
McGeoch

(10) Patent No.: US 7,075,096 B2
(45) Date of Patent: Jul. 11, 2006

(54) INJECTION PINCH DISCHARGE EXTREME ULTRAVIOLET SOURCE

(75) Inventor: Malcolm W. McGeoch, Brookline, MA (US)

(73) Assignee: Plex LLC, Brookline, MA (US)

( * ) Notice: Subject to any disclaimer, the term of this patent is extended or adjusted under 35 U.S.C. 154(b) by 83 days.

(21) Appl. No.: 10/911,334

(22) Filed: Aug. 4, 2004

(65) Prior Publication Data

US 2005/0178985 A1 Aug. 18, 2005

Related U.S. Application Data

(60) Provisional application No. 60/544,859, filed on Feb. 13, 2004.

(51) Int. Cl.
*H01J 65/04* (2006.01)

(52) U.S. Cl. ..... 250/504 R; 378/119

(58) Field of Classification Search ..... 250/504 R, 250/493.1; 378/119

See application file for complete search history.

(56) References Cited

U.S. PATENT DOCUMENTS 5,504,795 A 4/1996 McGeoch
6,031,241 A 2/2000 Silfvast et al.
6,064,072 A 5/2000 Partlo et al.
6,567,499 B1 5/2003 McGeoch
6,728,337 B1 4/2004 McGeoch
6,946,669 B1 * 9/2005 Kleinschmidt ..... 250/504 R

OTHER PUBLICATIONS

Krauz et al., Article: "*Plasma Focus Research At The Kurchatov Institute*", RRC Kurchatov Institute, Institute of Nuclear Fusion, Moscow, FORTOV, Institute for High Energy Densities of Associated Institute for High Temperatures, Russian Academy of Sciences, Moscow.

* cited by examiner

*Primary Examiner*—Kiet T. Nguyen
(74) *Attorney, Agent, or Firm*—Wolf, Greenfield & Sacks, P.C.

(57) ABSTRACT

A source of extreme ultraviolet or soft X-ray photon source includes discharge chamber containing a buffer gas, first and second electrodes in the discharge chamber configured to deliver a heating current to a plasma discharge region, and an injector to project a particle of a working substance into the plasma discharge region. The particle is evaporated and ionized by the heating current to form a hot plasma that radiates extreme ultraviolet or soft X-ray photons.

27 Claims, 8 Drawing Sheets

INJECTION PINCH DISCHARGE EXTREME ULTRAVIOLET SOURCE

CROSS REFERENCE TO RELATED APPLICATION

This application claims the benefit of provisional application Ser. No. 60/544,859, filed Feb. 13, 2004, which is hereby incorporated by reference in its entirety.

FIELD OF THE INVENTION

This invention relates to plasma X-ray sources and, more particularly, to sources of soft X-ray or extreme ultraviolet photons, wherein high power production of photons is achieved by injection of a solid-density particle into a plasma discharge region, followed by heating and ionization of the particle as a pulsed discharge is applied.

BACKGROUND OF THE INVENTION

Extreme ultraviolet (EUV) lithography requires an intense photon source at a wavelength in the region of 13 nm (nanometers) in order to image a pattern with circuit information onto a substrate that will carry an integrated circuit. Such soft X-ray or extreme ultraviolet photons can be generated in a hot plasma in which a chosen atomic species is multiply ionized. Examples relevant to lithography are the xenon plasma containing $Xe^{10+}$ and the tin plasma containing states $Sn^{7+}$—$Sn^{12+}$ that radiate at the 13.5 nm wavelength that is considered to be optimum for lithography because it matches the high reflectance band of Mo—Si multilayer mirrors.

A very effective method of plasma production for this purpose is the Star Pinch photon source, described in U.S. Pat. No. 6,567,499, issued May 20, 2003 to McGeoch, and U.S. Pat. No. 6,728,337, issued Apr. 27, 2004 to McGeoch. In that device, multiple beams of an ionized working gas are accelerated to a central location, with partial neutralization so that space charge does not build up and prevent the accumulation of material. This phase of operation positions the working material within a small volume at the center of the discharge chamber. An electric pulse is then applied between two groups of the ion beam sources with the result that the central plasma is compressed and heated to the density and temperature necessary for efficient radiation at 13.5 nm. Using xenon or tin as the radiating species, the optimum density and temperature are in the approximate range of $10^{18}$–$10^{20}$ electrons $cm^{-3}$ and 30 eV respectively. The Star Pinch photon source has operated at a repetition frequency of 2 kHz with 10 J delivered to the plasma on each pulse. Either a pure xenon plasma, or a plasma comprising a noble gas with a partial pressure of tin vapor, has been used in the Star Pinch photon source to generate a high power 13.5 nm photon beam with electrical efficiency of up to 1%, defined as radiated energy into $2\pi$ steradians within a 2% band at 13.5 nm divided by electrical input energy.

The Star Pinch photon source is especially suited to long life generation of extreme ultraviolet radiation because it generates the hot EUV-radiating plasma at a much larger distance from the discharge electrodes than other commonly used plasma generation devices, such as the Z-Pinch photon source disclosed in U.S. Pat. No. 5,504,795, issued Apr. 2, 1996 to McGeoch, the dense plasma focus source disclosed in U.S. Pat. No. 6,064,072, issued May 16, 2000 to Partlo et al, or the capillary discharge source disclosed in U.S. Pat. No. 6,061,241, issued Feb. 29, 2000 to Silfvast et al. Large separation between the plasma and the wall is necessary because the plasma exhaust contains energetic ions (300 eV to 1 keV) that erode the wall by sputtering. Using separations of 9 mm to 25 mm in the Star Pinch photon source, we have demonstrated more than 500 million pulse life, extrapolated from a 100 million pulse test. Increased separation will be possible so that life approaching 10 billion pulses is anticipated, entering the range of commercial viability for high volume semiconductor lithography.

For the process of EUV lithography, because of the limited etendue of the reflective projection optics, it is desirable to have a source volume as small as possible and preferably less than a sphere of 1 mm diameter. If the Star Pinch photon source, generates a plasma of length 2 mm (but sub-1 mm diameter), the utilization of radiation will, in this example, only be 50%. The length of the hot plasma generated in the Star Pinch photon source, is related to the diameter of the cooler (preceding) central plasma formed by the intersecting partially neutralized ion beams. Using xenon or tin (in diluent gas) as the working gas, the plasma size has been measured to lie in the range of 2.4–4.0 mm length by 0.6 mm diameter, defined as full width half maximum (FWHM) measurements. By careful design of these beams, the working material may be placed within a smaller volume with the consequence that 13.5 nm emission radiates from a smaller volume. However, there are limits to the amount of size reduction that can be achieved.

It is desirable therefore to provide improved methods and apparatus for generating extreme ultraviolet or soft X-ray photons.

SUMMARY OF THE INVENTION

The invention relates generally to operation of an extreme ultraviolet or soft X-ray source with a low atomic number buffer gas, and the injection of a particle of a higher atomic number EUV radiator to the center of the discharge region. The particle is evaporated and ionized by a heating current to form a hot plasma that radiates extreme ultraviolet or soft X-ray photons. Although described with reference to the Star Pinch photon source, the present invention applies to other types of photon sources.

In embodiments of the invention, an injector accelerates a solid-density particle of a working (soft X-ray producing) substance toward the center of the plasma discharge region. "Solid density" is a term that encompasses both liquid droplets and solid particles that have a density in the range 0.2 to 25 characteristic of regular solids and liquids stabilized by inter-atomic or inter-molecular forces of attraction. When the particle has reached the central location, a heating current is delivered to the plasma discharge region, applied, in some embodiments, between a first group of ion beam sources acting as a cathode and a second group of ion sources acting as an anode. The heating current compresses the buffer gas around the particle and heats both the gas and the particle, causing complete evaporation of the particle and rapid ionization of its constituent atoms to the multiply-charged species that radiate extreme ultraviolet light.

In one embodiment, the injector projects liquid droplets of the working substance generated in an orifice or nozzle at the periphery of the chamber. The working substance may comprise tin, xenon, or another material with a strong transition array in the soft X-ray region and particularly in the extreme ultraviolet region. The buffer gas is of relatively low atomic number and may typically be helium, neon or argon, but is not limited to these gases.

In another embodiment, the injector projects solid pellets of the working substance from an apparatus at the periphery of the chamber. The same choices of working substance and buffer gas apply.

According to a first aspect of the invention, a source of photons is provided. The source comprises a discharge chamber; first and second groups of ion beam sources in the discharge chamber, each electrostatically accelerating a beam of ions of a buffer gas toward a plasma discharge region, said first group of ion beam sources acting as a cathode and said second group of ion beam sources acting as an anode for delivering a heating current to the plasma discharge region; and an injector to project a particle of a working substance into the plasma discharge region, wherein the particle is evaporated and ionized by the heating current to form a hot plasma that radiates extreme ultraviolet or soft X-ray photons.

According to a second aspect of the invention, a system for generating photons is provided. The system comprises a housing defining a discharge chamber; a gas source for supplying a buffer gas to the discharge chamber; first and second groups of ion beam sources in the discharge chamber, each electrostatically accelerating a beam of ions of the buffer gas toward a plasma discharge region, said first group of ion beam sources acting as a cathode and said second group of ion beam sources acting as an anode; a first voltage source for applying an accelerating voltage to said first and second groups of ion beam sources; a second voltage source for supplying a heating current through the plasma discharge region between said first and second groups of ion beam sources; an injector to project a particle of a working substance into the plasma discharge region, wherein the particle is evaporated and ionized by the heating current to form a hot plasma that radiates extreme ultraviolet or soft X-ray photons; and a vacuum system for controlling the pressure of the buffer gas in the discharge chamber.

According to a third aspect of the invention, a source of photons is provided. The source comprises a discharge chamber containing a buffer gas; a first group of ion beam sources directed toward a plasma discharge region in the discharge chamber, wherein a component of said first group of ion sources constitutes a first electrode; a second electrode spaced from the plasma discharge region; a first power supply for energizing the first group of ion beam sources to electrostatically accelerate gas ion beams of the buffer gas from the first group of ion beam sources toward the plasma discharge region; an injector to project a particle of a working substance into the plasma discharge region; and a second power supply coupled between the first and second electrodes for delivering a heating current to the plasma discharge region, wherein the particle is evaporated and ionized by the heating current to form a hot plasma that radiates extreme ultraviolet or soft X-ray photons.

According to a fourth aspect of the invention, a system for generating photons is provided. The system comprises a discharge chamber containing a buffer gas; a first group of ion beam sources directed toward a plasma discharge region in the discharge chamber, wherein a component of said first group of ion sources constitutes a first electrode; a second electrode spaced from the plasma discharge region; a first power supply for energizing the first group of ion beam sources to electrostatically accelerate ion beams of the buffer gas from the first group of ion beam sources toward the plasma discharge region; an injector to project a particle of a working substance into the plasma discharge region; a second power supply coupled between the first and second electrodes for delivering a heating current to the plasma discharge region, wherein the particle is evaporated and ionized by the heating current to form a hot plasma that radiates extreme ultraviolet or soft X-ray photons; and a vacuum system for controlling the pressure of the buffer gas in the discharge chamber.

According to a fifth aspect of the invention, a source of photons is provided. The source comprises a discharge chamber containing a buffer gas; a first group of electron beam sources directed toward a plasma discharge region in the discharge chamber, wherein a component of said group of electron beam sources constitutes a first electrode; a second electrode spaced from the plasma discharge region; a first power supply for energizing the first group of electron beam sources to electrostatically accelerate beams of electrons toward the plasma discharge region; an injector to project a particle of a working substance into the plasma discharge region; and a second power supply coupled between the first and second electrodes for delivering a heating current to the plasma discharge region, wherein the particle is evaporated and ionized by the heating current to form a hot plasma that radiates extreme ultraviolet or soft X-ray photons.

According to a sixth aspect of the invention, a method for generating photons is provided. The method comprises electrostatically accelerating a plurality of beams of ions of a buffer gas toward a plasma discharge region; injecting a particle of a working material into the discharge region; and supplying a heating current through the plasma discharge region, wherein the particle is evaporated and ionized by the heating current to form a hot plasma that radiates extreme ultraviolet or soft X-ray photons.

According to a seventh aspect of the invention, a method for generating photons is provided. The method comprises electrostatically accelerating a plurality of beams of electrons through a buffer gas toward a plasma discharge region; injecting a particle of a working material into the discharge region; and supplying a heating current through the plasma discharge region, wherein the particle is evaporated and ionized by the heating current to form a hot plasma that radiates extreme ultraviolet or soft X-ray photons.

According to an eighth aspect of the invention, a source of photons is provided. The source comprises a discharge chamber containing a buffer gas; first and second electrodes in the discharge chamber configured to deliver a heating current to a plasma discharge region; and an injector to project a particle of a working substance into the plasma discharge region, wherein the particle is evaporated and ionized by the heating current to form a hot plasma that radiates extreme ultraviolet or soft X-ray photons.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
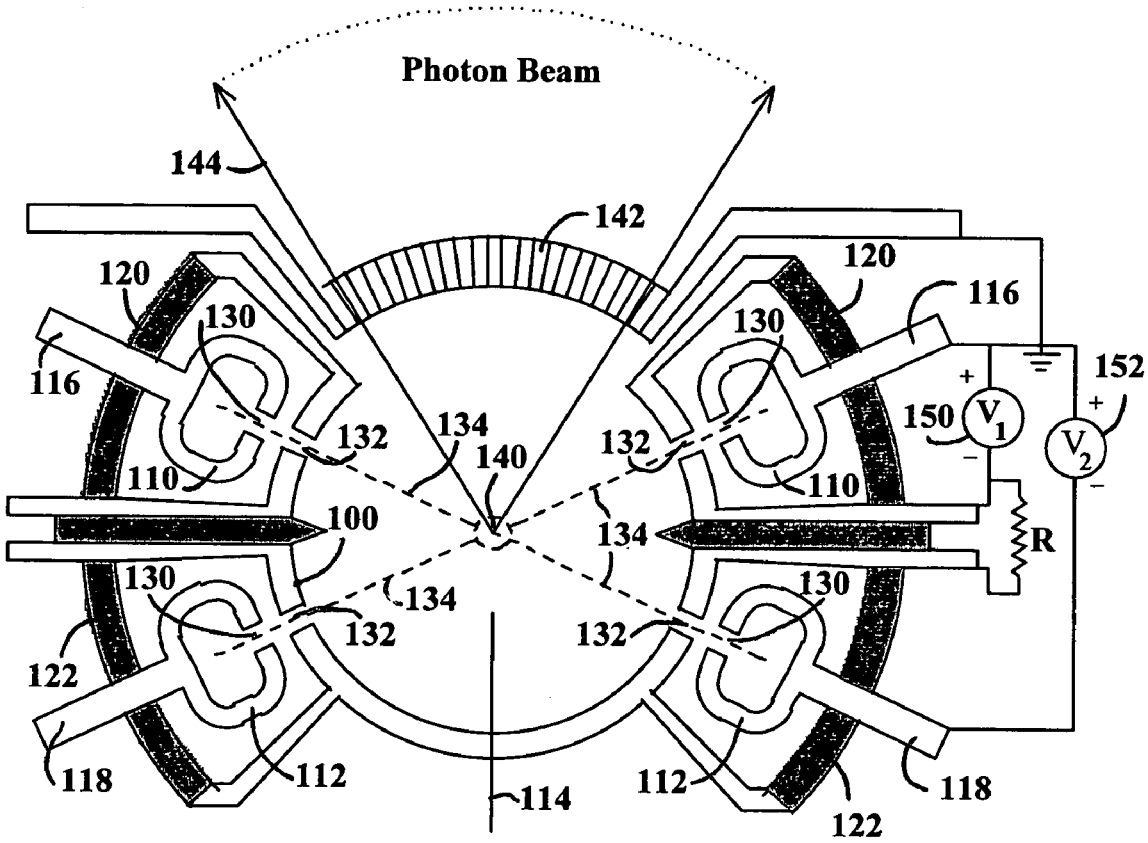
FIG. 1 is a cross-sectional view of an extreme ultraviolet source based on the acceleration of multiple ion beams to a central plasma discharge region.

A simplified cross-sectional side view of a prior art extreme ultraviolet photon source of the Star Pinch type is shown in FIG. 1. A chamber, or inner shell 100, which may be spherical, has an electrically conducting wall and a hollow interior. The photon source further includes ring electrodes 110 and 112 disposed around a source axis 114 outside inner shell 100. Ring electrodes 110 and 112 may include flanges 116 and 118, respectively, for electrical connection and mechanical support. Ring electrodes 110 and 112 are supported by insulators 120 and 122, respectively. Each of ring electrodes 110 and 112 may comprise a hollow ring or toroid. Alternately, ring electrodes 110 and 112 may comprise a circular array of cavities. Each of ring electrode 110 and ring electrode 112 has a plurality of holes 130, and inner shell 100 has a hole 132 corresponding to each hole 130 to form hole pairs 130,132. The holes 130 and 132 of each hole pair are aligned and define a plasma channel 134 that intersects a central discharge region 140. In one embodiment, each of ring electrodes 110 and 112 has 24 holes 130 spaced around axis 114. The spaces between each of ring electrodes 110 and 112 and inner shell 100 constitute acceleration gaps for electrostatic acceleration of ion beams. Each hole pair 130, 132 defines an ion beam source, thus providing 48 ion beam sources having plasma channels 134 intersecting plasma discharge region 140.

The photon source shown in FIG. 1 may be mounted in a housing, as described below in connection with FIG. 5. The housing is filled with a working gas at low pressure, typically 0.1–100 millitorr. Inner shell 100 may be provided with a beam exit aperture, such as beam exit structure 142 comprising multiple, aligned small bore holes or slots having high optical transmission for a photon beam and low conductance for the gas in order to provide near vacuum conditions for photon propagation outside of the chamber. A photon beam 144 of extreme ultraviolet or soft X-ray radiation is emitted from inner shell 100 through beam exit structure 142.

A power supply 150 is connected between ring electrode 110 and inner shell 100, and a power supply 152 is connected between ring electrode 110 and ring electrode 112. Each of power supplies 150 and 152 is capable of providing high voltage pulses having pulse widths of 0.1–10 microseconds.

Figure 2:
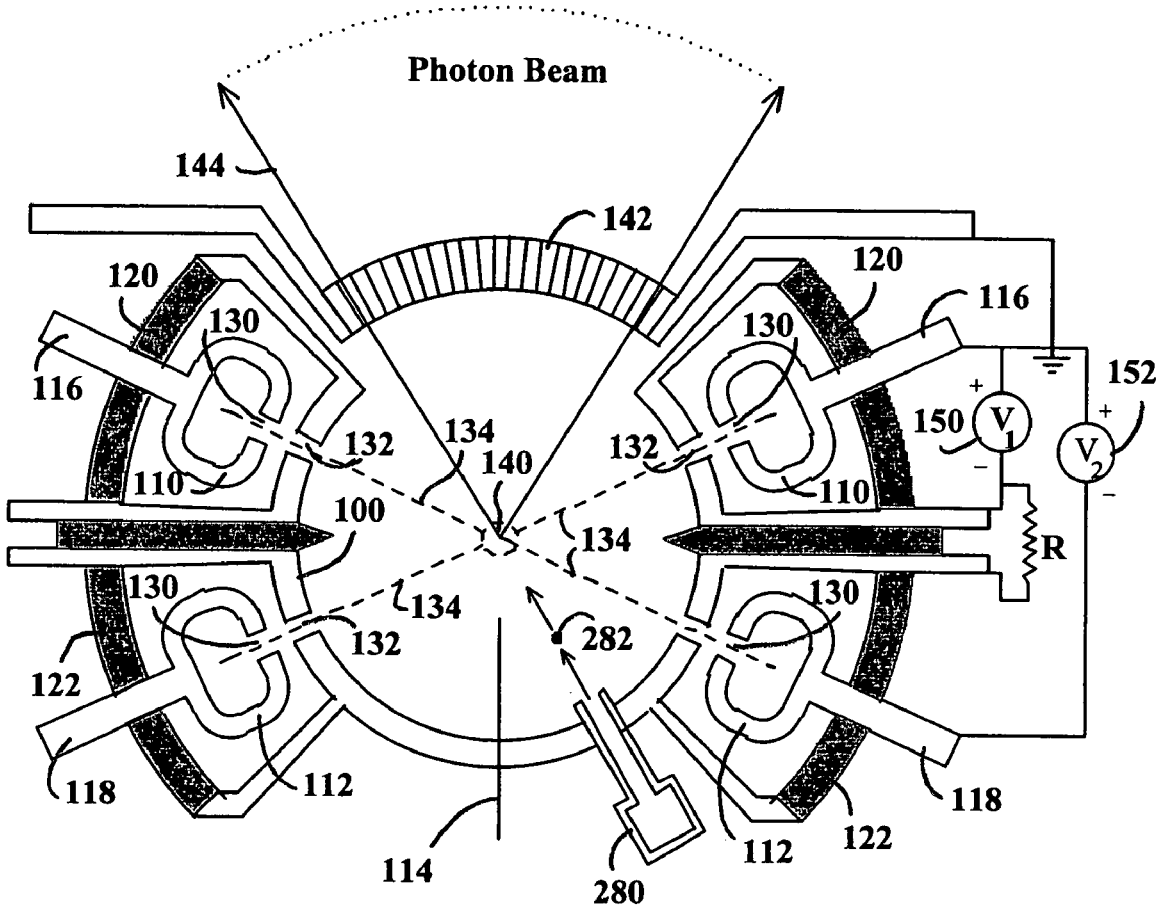
FIG. 2 is a cross-sectional view of a photon source in accordance with a first embodiment of the invention.

A simplified cross-sectional side view of an extreme ultraviolet or soft X-ray photon source in accordance with a first embodiment of the invention is shown in FIG. 2. Like elements in FIGS. 1 and 2 have the same reference numerals. The working gas does not need to be an X-ray emitting gas, and is referred to as a buffer gas. The buffer gas may be a light molecular gas (atomic number less than about 20) at low pressure, typically in a range of about 0.1–100 millitorr. Buffer gases such as hydrogen, helium, nitrogen, oxygen, neon and argon may be utilized. As discussed below, a compound buffer gas may be utilized to enhance heat flux.

The embodiment of FIG. 2 includes an injector apparatus 280 aimed at the central plasma discharge region 140. The injector is capable of projecting, on command, a small particle or droplet of an X-radiating substance. The particle may be of solid-density, as defined above, and may be in the liquid or solid state. A small orifice or nozzle may be located at the periphery of the discharge chamber. One method that has been used is the pulsed pressurization of a reservoir of the liquid substance behind a small orifice, forcing a droplet through the orifice. In certain circumstances this droplet remains in the liquid state throughout its flight, but in other cases the droplet can solidify during its flight. In one example, a droplet of liquid tin in utilized. The particle should contain sufficient atoms of the X-radiating substance to efficiently radiate as much of the available discharge energy as possible. Experience has indicated that very approximately $10^{14}$ atoms of radiating substance per 1 Joule of discharge energy are required. In the case of tin as the radiator, this corresponds to a particle diameter of 30 microns and a mass of $1.0\times10^{-7}$ grams. It is not necessary to use a pure element as the working substance, but compounds, solutions of compounds or suspensions of pure or compound substances may be used.

The injected particle can be any element or combination of elements that has a particular extreme ultraviolet or soft X-ray emission band that is desired for a particular application. This includes all non-gaseous elements, and also gases that can be condensed into a liquid at reasonable temperatures. For example, the injected particle may be tin, xenon or another material with a strong transition array in the soft X-ray region and particularly in the extreme ultraviolet region close to 13.5 nm. Preferably, a single particle is utilized so that photon emission is from as small a volume as possible. A single particle of appropriate size, such as 30 microns in diameter, will ionize in the conditions of the Star Pinch photon source.

In the embodiment of FIG. 2, injector 280 is mounted in the bottom portion of inner shell 100. However, the injector 280 can be mounted in other locations, such as the top center of inner shell 100, if the injector can be configured to avoid blocking a substantial amount of the photon beam.

In a first phase of operation, power supply 150 applies a negative DC potential to inner shell 100 relative to ring electrodes 110 and 112. Ring electrodes 110 and 112 remain at the same electrical potential during this phase of operation, connected through low-impedance power supply 152. Power supply 150 supplies a DC current, typically 1–100 milliamps, to maintain a discharge in all hole pairs 130, 132. The plasma channels 134 defined by hole pairs 130, 132 intersect at plasma discharge region 140. Power supply 150 is then pulsed, typically a 1–10 microsecond pulse, to a negative voltage, typically 1–20 kV, and drives an increased current, typically 1–100 Amps, through the plasma channels 134. Ions of the buffer gas are accelerated toward plasma discharge region 140. During passage along plasma channels 134, the ions experience neutralizing collisions in a resonant charge exchange process, so that the ion beams are at least partially neutralized before they enter plasma discharge region 140 to form a dense plasma.

In a second phase of operation following or during the first phase of operation, solid-density particle 282 is projected toward plasma discharge region 140 with a velocity typically in the range of 1–100 m $sec^{-1}$. In order to achieve such velocities, it is possible to apply additional acceleration to the particle after its flight has begun. The particle may be charged negatively in an electron beam and accelerated through a hole in a positively charged electrode, or pass through multiple acceleration gaps, as described in very extensive reported research on the acceleration of charged particles. When the particle has reached plasma discharge region 140, a third phase of operation is executed.

During the third phase of operation, power supply 152 applies a high current pulse, typically 0.1–10 microseconds and 1–100 kiloamps, to ring electrodes 110 and 112. The pulse from power supply 152 may be initiated during the pulse from power supply 150 or at most slightly after the end of the pulse from power supply 150. Thus, power supply 152 is typically triggered about 0.1–10 microseconds after power supply 150 is triggered. The circuit is completed through plasma channels 134. In particular, ring electrode 110 defines an upper conical array of plasma channels 134, and ring electrode 112 defines a lower conical array of plasma channels 134. In this embodiment, ring electrode 110 constitutes a first electrode and ring electrode 112 constitutes a second electrode for application of a heating current to the plasma in plasma discharge region 140. The heating pulse compresses and heats the buffer gas in a small region around the particle, within plasma discharge region 140, causing complete evaporation of the particle accompanied by ionization of the evaporated atoms to highly ionized states that emit extreme ultraviolet or soft X-ray photons.

The timing of the second and third phases is dictated by a particle velocity in the range of 1–100 m $sec^{-1}$ and a need to apply the pulse when the particle is within about 100 micrometers from the center of the discharge chamber. This requires a highest timing accuracy of one microsecond. Slower particles permit a correspondingly lesser timing accuracy. If not evaporated, the particle passes through the center of the discharge chamber.

Figure 3:
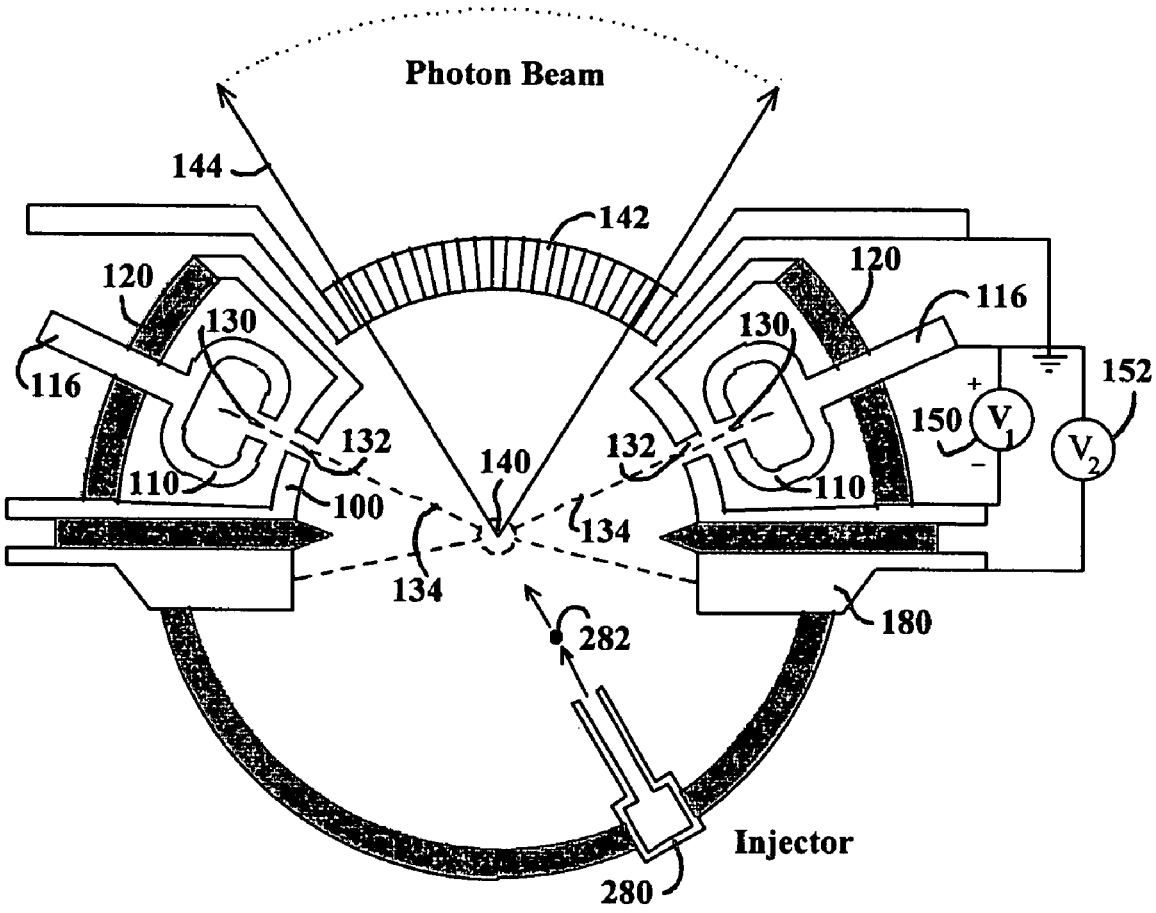
FIG. 3 is a cross-sectional view of a photon source in accordance with a second embodiment of the invention.

FIG. 3 illustrates a second embodiment of the invention in which a second electrode 180 is disposed in proximity to the plasma discharge region. Second electrode 180 in FIG. 3 is used in place of electrode 112 in FIG. 2 and may be configured as an annular ring connected to power supply 152. Like elements in FIGS. 1–3 have the same reference numerals.

Operation is in three stages. In the first stage, a buffer gas within the chamber, at low pressure in a range of about 0.1 to 100 millitorr, provides a medium for an electrical discharge maintained between ring electrode 110 and inner shell 100. The discharge is concentrated at a multiplicity of pairs of opposed holes 130 and 132 arrayed around ring electrode 110 and inner shell 100, respectively. Ion beams 134, generated in the hole pair acceleration gaps, intersect discharge region 140. The function of the beams is to define an array of ionization tracks connecting ring electrode 110 with plasma discharge region 140. In the second stage, injector 280 accelerates a small particle of solid-density material 282 toward plasma discharge region 140. In the third stage, which takes place once the particle 282 has reached the discharge region 140, power supply 152 delivers a heating pulse to plasma discharge region 140 via electrodes 110 and 180. The heating pulse compresses and heats the buffer gas in a small region around the particle, within plasma discharge region 140, causing complete evaporation of the particle and ionization of the evaporated atoms to highly ionized states that emit extreme ultraviolet or soft X-ray photons.

Figure 4:
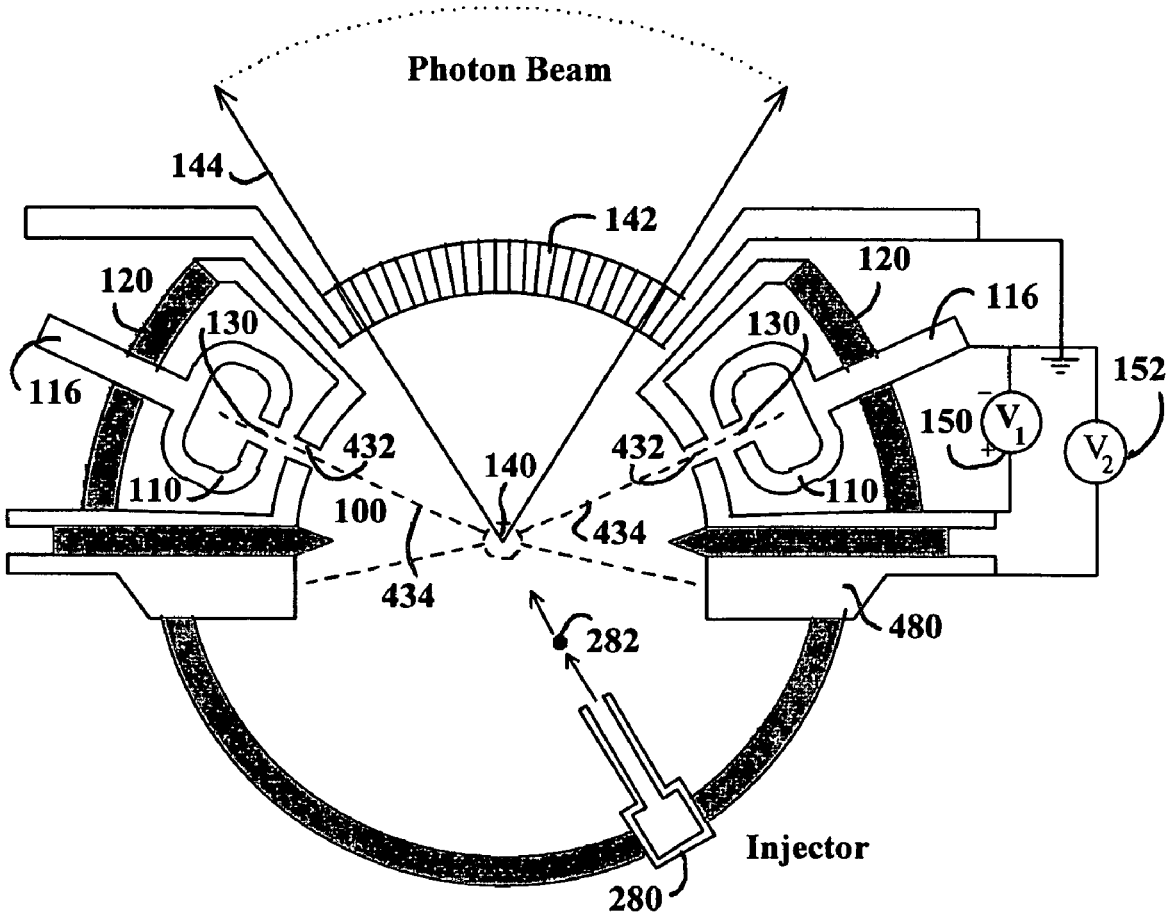
FIG. 4 is a cross-sectional view a photon source in accordance with of a third embodiment of the invention.

FIG. 4 illustrates a third embodiment of the invention in which ionization tracks 434 are generated by the passage of a multiplicity of electron beams. In the embodiment of FIG. 4, each hole pair 130, 432 defines an electron beam source. A second electrode 480 is disposed in proximity to the plasma discharge region. Second electrode 480 may be configured as an annular ring connected to power supply 152. Like elements in FIGS. 1–4 have the same reference numerals.

Operation is in three stages. In the first phase of operation the electron beams are generated by application of a negative pulse to ring electrode 110 relative to inner shell 100. The discharge that generates the electron beams is concentrated at a multiplicity of pairs of opposed holes 130 and 432 arrayed around ring electrode 110 and inner shell 100, respectively. The electron beams generate ionization tracks 434 that intersect plasma discharge region 140. In the second stage, injector apparatus 280 accelerates a small particle of solid-density material 282 toward plasma discharge region 140. In the third stage, which takes place once the particle 282 has reached the discharge region 140, power supply 152 delivers a heating pulse to plasma discharge region 140 via first electrode 110 and second electrode 480. The heating pulse compresses and heats the buffer gas in a small region around the particle, within plasma region 140, causing complete evaporation of the particle and ionization of the evaporated atoms to highly ionized states that emit extreme ultraviolet or soft X-ray photons.

Figure 5:
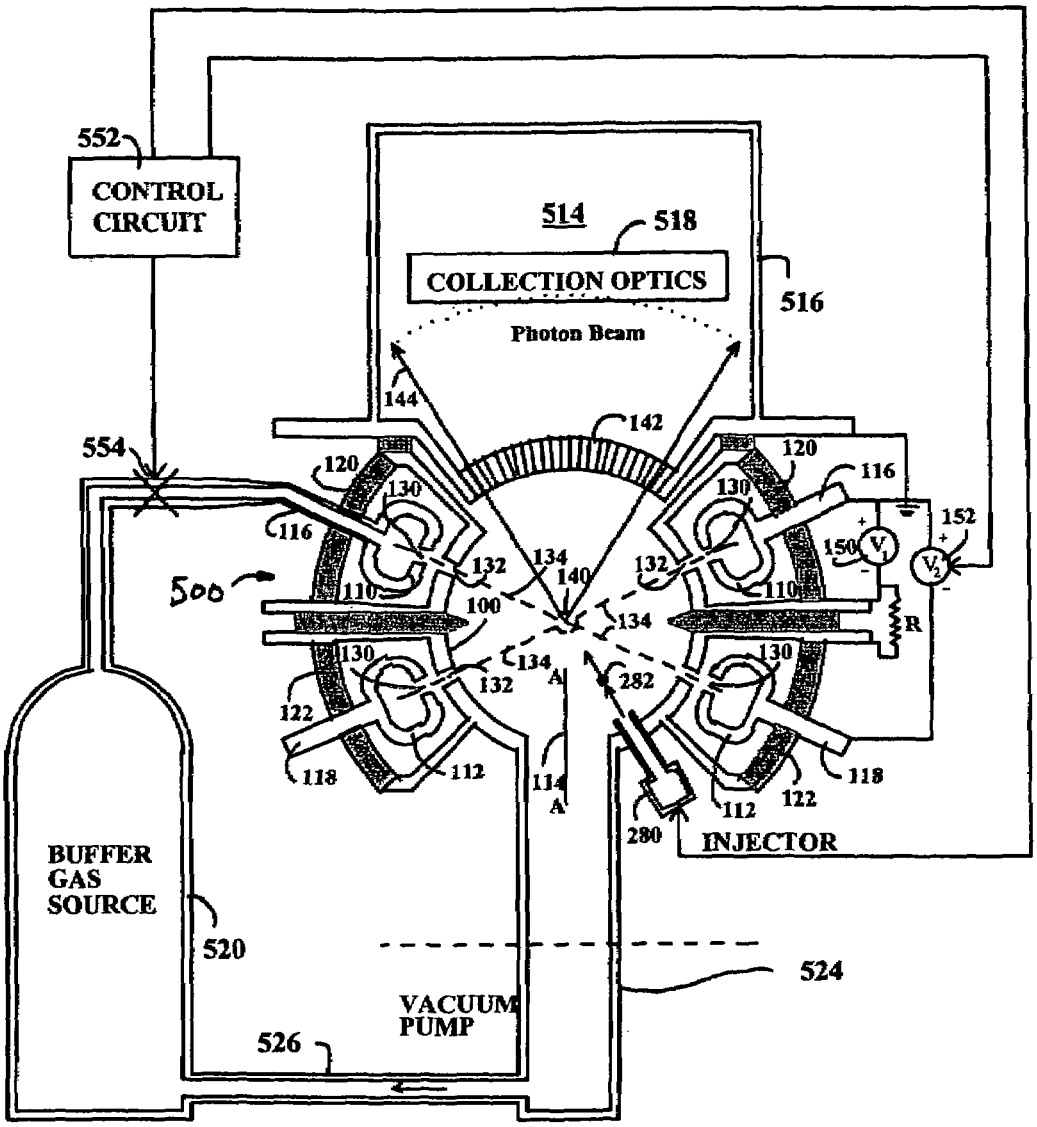
FIG. 5 is a schematic representation of a system for generating photons in accordance with a fourth embodiment of the invention.

A system for generating photons in accordance with a fourth embodiment of the invention is shown schematically in FIG. 5. The system includes a photon source 500, which may correspond to the photon source shown in FIG. 2, the photon source shown in FIG. 3, the photon source shown in FIG. 4, the photon source shown in FIG. 6, or any other photon source within the scope of the present invention. In the system of FIG. 5, photon source 500 corresponds to the photon source shown in FIG. 2 and described above. Like elements in FIGS. 2 and 5 have the same reference numerals.

Photon source 500 is mounted in a housing (not shown) that defines a discharge chamber. A top aperture in inner shell 100 is coupled through beam exit structure 142 to a collection region 514 that is defined by an enclosure 516. Enclosure 516 contains collection optics 518 for relaying photon beam 144 to a remote point of use. Beam exit structure 142 allows propagation of photons from inner shell 100 to collection region 514 but impedes flow of gas from inner shell 100 to collection region 514.

An external buffer gas source 520 supplies a controlled flow of buffer gas to the plasma chamber through one or more inlets in ring electrode 110. A control valve 554, located between gas source 520 and the photon source, is controlled by a control circuit 552. A bottom aperture in the inner shell 100 is coupled to a vacuum pump 524. An outlet 526 of vacuum pump 524 is connected to gas source 520 to form a gas recirculation system. Gas source 520 and the vacuum pump 524 are connected to the photon source in a closed loop configuration that permits recirculation of the buffer gas through the discharge chamber. Control circuit 552 drives injector 280 and times the initiation of the heating pulse from power supply 152 to coincide with the arrival of particle 282 at plasma discharge region 140. The system of FIG. 5 operates as described above in connection with FIG. 2.

Figure 6:
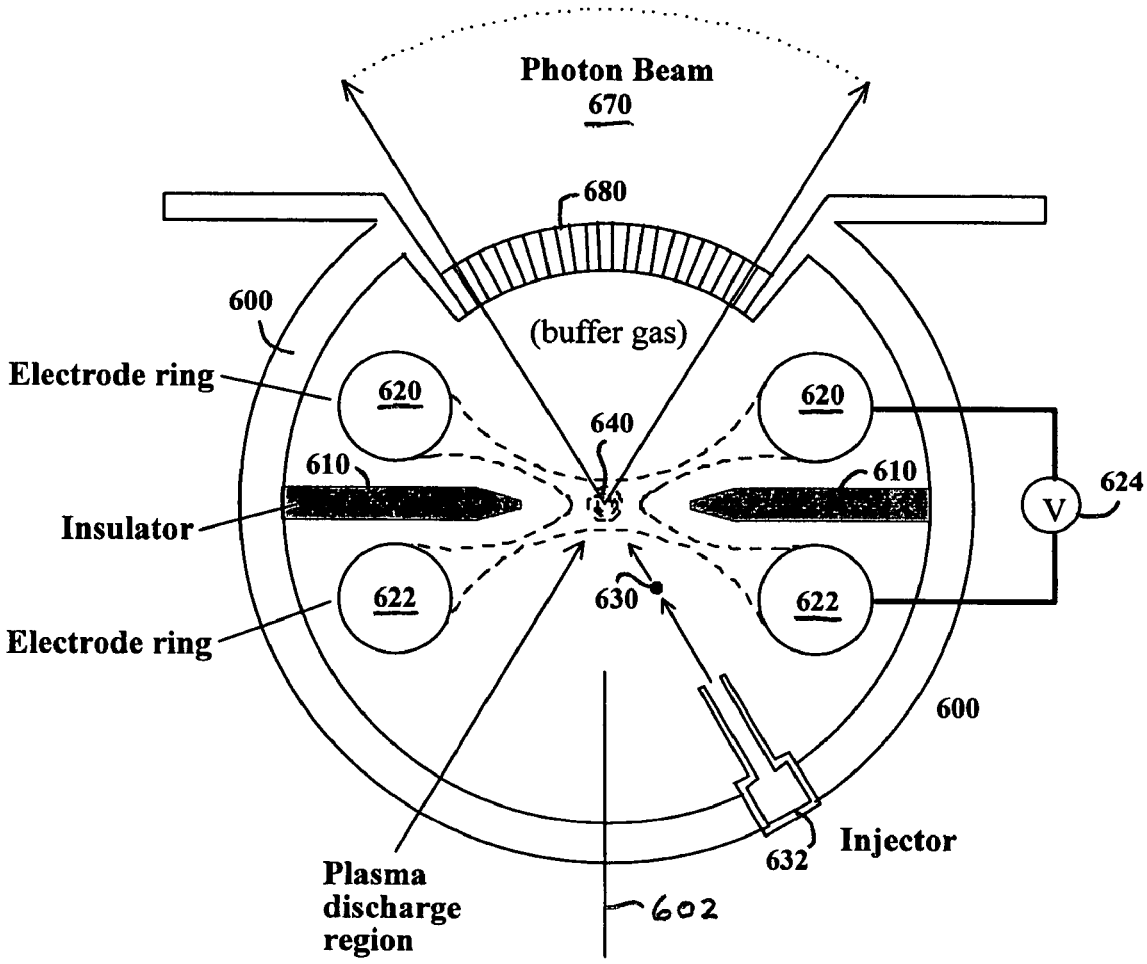
FIG. 6 is a cross-sectional view of a photon source in accordance with a fifth embodiment of the invention.

A simplified cross-sectional side view of an extreme ultraviolet or soft X-ray photon source in accordance with a fifth embodiment of the invention is shown in FIG. 6. A chamber 600 on an axis of symmetry 602 containing a buffer gas holds two ring electrodes 620 and 622 (shown in cross section) separated by insulator 610. A power supply 624 is coupled between electrodes 620 and 622. A solid-density particle 630 is injected from an injector 632 toward a central plasma discharge region 640. When the particle has reached discharge region 640, an electrical pulse generated by power supply 624 is applied between electrodes 620 and 622, passing through the buffer gas and central discharge region 640. The buffer gas is compressed and heated in the region around the particle, causing its evaporation, ionization and the emission of extreme ultraviolet or soft X-ray photons. A photon beam 670 exits from the discharge region through a beam exit structure 680 which has the functions of providing a high transparency to soft X-ray photons and providing a low conductance to the buffer gas, so that a relatively low gas pressure can be maintained outside structure 680, giving higher transmission for photons in the external propagation region.

Figure 7:
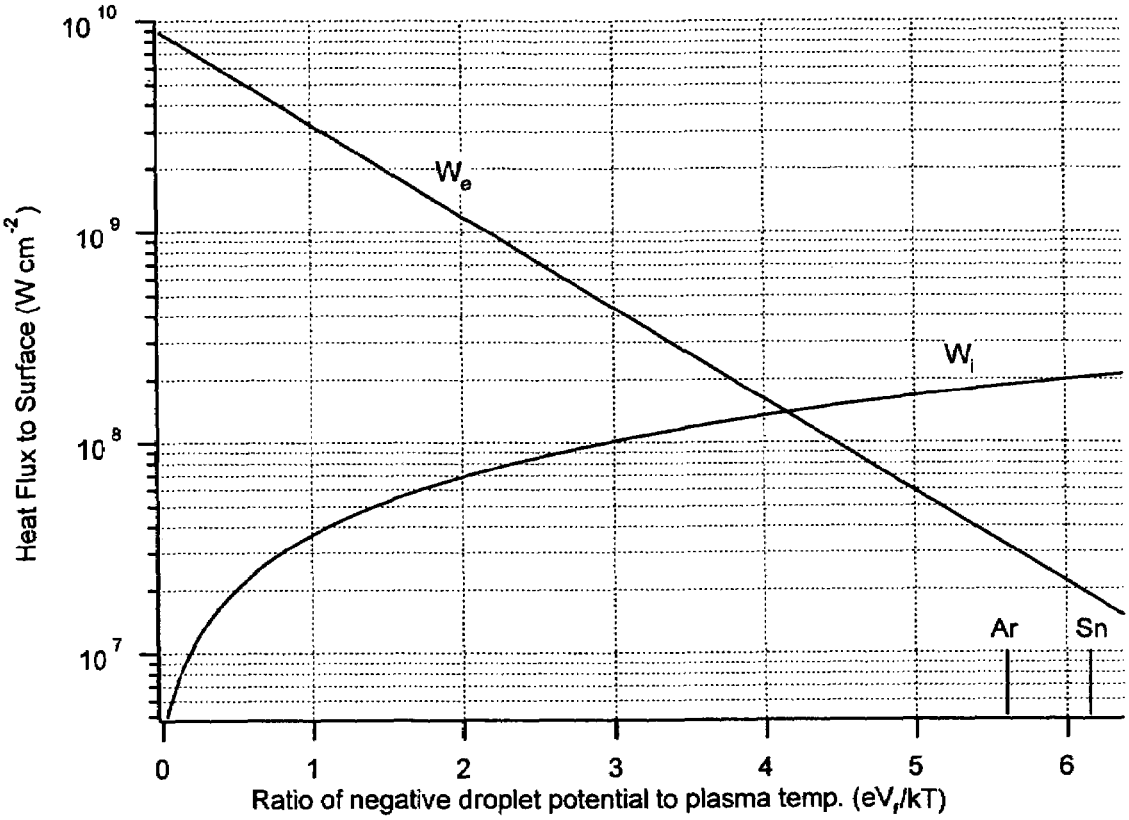
FIG. 7 illustrates the relative electron and ion heat fluxes onto a particle surface when the particle has charged negatively in the pinch plasma.

An investigation into the rates of heating and ionization of particles injected into a plasma pinch has shown that in pinch conditions suitable for EUV generation the initial heat flux onto the particle surface is mainly borne by incident plasma ions, rather than electrons. Although the electron heat flux that is potentially available can approach 10 $GWcm^{-2}$, the injected particle charges to a voltage $V_f=-150V$ and the actual electron heat flux is reduced to 50 $MWcm^{-2}$, whereas the ion heat flux is raised to 200 $MWcm^{-2}$ (numbers refer to an argon plasma of average charge Z=8, electron density $2\times10^{19}$ $cm^3$ and temperature 30 eV). The trend is illustrated in FIG. 7, which shows electron and ion heat fluxes ($W_e$ and $W_i$) as a function of the normalized particle potential ($eV_f/kT$) where kT is the energy of plasma particles. There are factors that can reduce the particle potential and restore the electron heat flux, to rapidly ionize the injected particle. One of these factors is photoemission (of electrons) as radiation from the pinch plasma strikes the particle surface. The radiation field in light buffer gases such as helium, neon and argon, is not sufficient to reduce the particle potential in this manner. However, seeding the light buffer gas with a heavier element such as xenon that has intense EUV emission can enhance photoemission and restore the electron heat flux.

Figure 8:
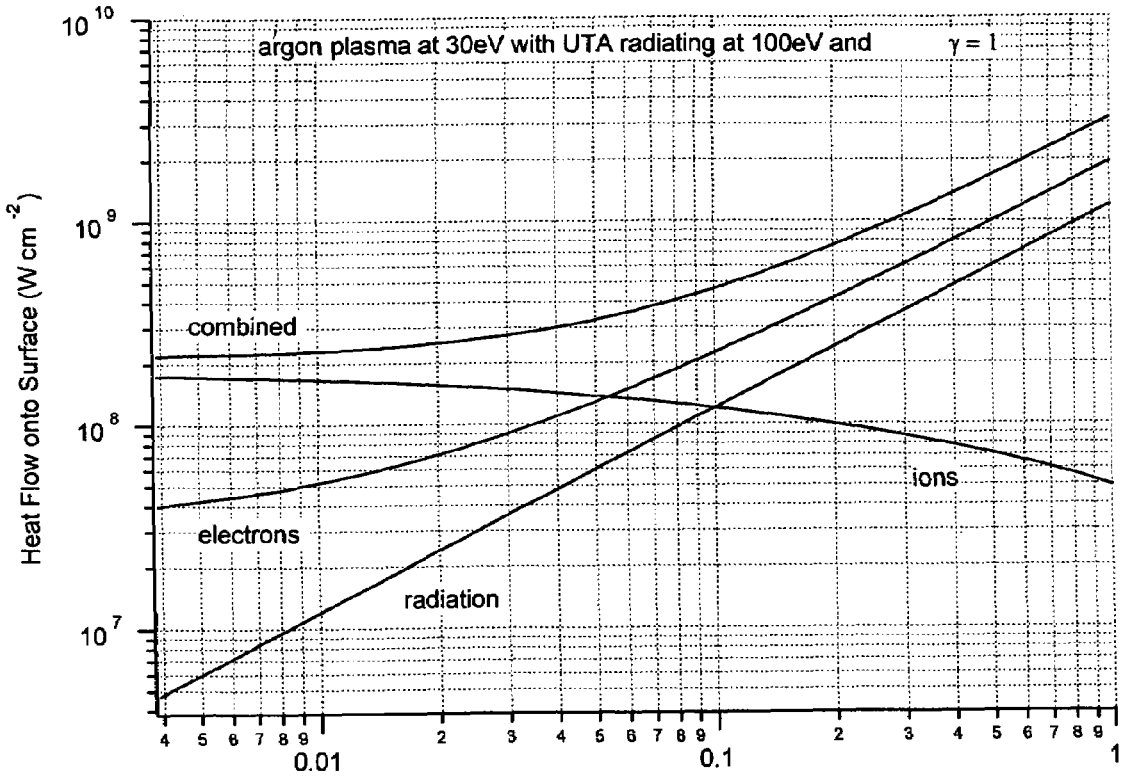
FIG. 8 illustrates the use of a seed radiator component in the buffer gas to enhance photoemission and thereby enhance the electron heat flux onto the particle.

FIG. 8 shows a calculation based on seeding of an argon plasma with an element that has a strong transition array at 100 eV (such as xenon). The ordinate of this graph represents a parameter η, defined as the ratio of the peak transition array intensity divided by the Planck radiation intensity at the same wavelength. As the peak 100 eV intensity approaches the Planck spectral intensity, there can be substantial reduction of the particle potential and restoration of the electron heat flux, according to the results of FIG. 7. The conditions for the calculation represented in FIG. 8 were a photoemission quantum efficiency of unity and an argon plasma of average charge Z=8, electron density $2\times10^{19}$ $cm^{-3}$ and temperature 30 eV. The concentration of the minority component in the buffer gas must not be so high as to radiate significant energy relative to that from the ionized particle itself. For example, approximately 5% xenon in an argon buffer gas satisfies this criterion.

As noted above, the buffer gas may include light elements such as hydrogen, helium, nitrogen, oxygen, neon and argon, or other light molecular gases (atomic number less than about 20). The radiating component added to buffer gas may include krypton or xenon, or other gases containing an element with an atomic number higher than about 20. The proportion of the radiating component should be at most about 10% so as not to radiate more than the injected particle radiates (after ionization) during the process.

While there have been shown and described what are at present considered the preferred embodiments of the present invention, it will be obvious to those skilled in the art that various changes and modifications may be made therein without departing from the scope of the invention as defined by the appended claims.

The invention claimed is:

1. A source of photons comprising:

a discharge chamber;

first and second groups of ion beam sources in the discharge chamber, each electrostatically accelerating a beam of ions of a buffer gas toward a plasma discharge region, said first group of ion beam sources acting as a cathode and said second group of ion beam sources acting as an anode for delivering a heating current to the plasma discharge region; and an injector to project a particle of a working substance into the plasma discharge region, wherein the particle is evaporated and ionized by the heating current to form a hot plasma that radiates extreme ultraviolet or soft X-ray photons.

2. A source as defined in claim 1, wherein said ion beams precede said heating current.

3. A source as defined in claim 1, wherein said heating current is pulsed and wherein said ion beams comprise pulsed ion beams that precede said pulsed heating current.

4. A source as defined in claim 1, wherein said ion beam sources comprise continuous ion beam sources and wherein said heating current is pulsed.

5. A source as defined in claim 1, wherein the particle comprises a liquid droplet of the working substance.

6. A source as defined in claim 1, wherein the particle comprises a solid pellet of the working substance.

7. A source as defined in claim 1, wherein the working substance comprises tin.

8. A source as defined in claim 1, wherein the buffer gas comprises helium, neon or argon.

9. A source as defined in claim 1, wherein the particle comprises a solid-density particle.

10. A source as defined in claim 1, wherein the buffer gas comprises a first component of lower atomic number and a second component of higher atomic number, the second component present in a small proportion in order to provide radiation that enhances photoemission from the surface of the injected particle, accelerating its ionization.

11. A source as defined in claim 10, wherein the first component of the buffer gas comprises helium, neon or argon and the second component of the buffer gas comprises krypton or xenon.

12. A system for generating photons comprising:

a housing defining a discharge chamber;

a gas source for supplying a buffer gas to the discharge chamber;

first and second groups of ion beam sources in the discharge chamber, each electrostatically accelerating a beam of ions of the buffer gas toward a plasma discharge region, said first group of ion beam sources acting as a cathode and said second group of ion beam sources acting as an anode;

a first voltage source for applying an accelerating voltage to said first and second groups of ion beam sources;

a second voltage source for supplying a heating current through the plasma discharge region between said first and second groups of ion beam sources;

an injector to project a particle of a working substance into the plasma discharge region, wherein the particle is evaporated and ionized by the heating current to form a hot plasma that radiates extreme ultraviolet or soft X-ray photons; and a vacuum system for controlling the pressure of the buffer gas in the discharge chamber.

13. A source of photons comprising:

a discharge chamber containing a buffer gas;

a first group of ion beam sources directed toward a plasma discharge region in the discharge chamber, wherein a component of said first group of ion sources constitutes a first electrode;

a second electrode spaced from the plasma discharge region;

a first power supply for energizing the first group of ion beam sources to electrostatically accelerate gas ion beams of the buffer gas from the first group of ion beam sources toward the plasma discharge region;

an injector to project a particle of a working substance into the plasma discharge region; and a second power supply coupled between the first and second electrodes for delivering a heating current to the plasma discharge region, wherein the particle is evaporated and ionized by the heating current to form a hot plasma that radiates extreme ultraviolet or soft X-ray photons.

14. A source as defined in claim 13, wherein said ion beams precede said heating current.

15. A source as defined in claim 13, wherein said heating current is pulsed and wherein said ion beams comprise pulsed ion beams that precede said pulsed heating current.

16. A source as defined in claim 13, wherein said ion beam sources comprise continuous ion beam sources and wherein said heating current is pulsed.

17. A source as defined in claim 13, wherein the particle comprises a liquid droplet of the working substance.

18. A source as defined in claim 13, wherein the particle comprises a solid pellet of the working substance.

19. A source as defined in claim 13, wherein the working substance comprises tin.

20. A source as defined in claim 13, wherein the buffer gas comprises helium, neon or argon.

21. A source as defined in claim 13, wherein the second electrode comprises a component of a second group of ion beam sources.

22. A source as defined in claim 13, wherein the particle comprises a solid-density particle.

23. A source as defined in claim 13, wherein the buffer gas comprises a first component of lower atomic number and a second component of higher atomic number, the second component present in a small proportion in order to provide radiation that enhances photoemission from the surface of the injected particle, accelerating its ionization.

24. A source as defined in claim 23, wherein the first component comprises helium, neon or argon and the second component comprises krypton or xenon.

25. A system for generating photons, comprising:

a discharge chamber containing a buffer gas;

a first group of ion beam sources directed toward a plasma discharge region in the discharge chamber, wherein a component of said first group of ion sources constitutes a first electrode;

a second electrode spaced from the plasma discharge region;

a first power supply for energizing the first group of ion beam sources to electrostatically accelerate ion beams of the buffer gas from the first group of ion beam sources toward the plasma discharge region;

an injector to project a particle of a working substance into the plasma discharge region;

a second power supply coupled between the first and second electrodes for delivering a heating current to the plasma discharge region, wherein the particle is evaporated and ionized by the heating current to form a hot plasma that radiates extreme ultraviolet or soft X-ray photons; and a vacuum system for controlling the pressure of the buffer gas in the discharge chamber.

26. A system for generating photons as defined in claim 25, wherein the second electrode comprises a component of a second group of ion beam sources.

27. A method for generating photons, comprising:

electrostatically accelerating a plurality of beams of ions of a buffer gas toward a plasma discharge region;

injecting a particle of a working material into the discharge region; and supplying a heating current through the plasma discharge region, wherein the particle is evaporated and ionized by the heating current to form a hot plasma that radiates extreme ultraviolet or soft X-ray photons.

* * * * *